US010518116B2

(12) United States Patent
Calkin

(10) Patent No.: US 10,518,116 B2
(45) Date of Patent: Dec. 31, 2019

(54) PATIENT EVACUATION AND RECOVERY HAULING SYSTEM

(71) Applicant: Skedco, Inc., Tualatin, OR (US)

(72) Inventor: Carston R. Calkin, Tualatin, OR (US)

(73) Assignee: SKEDCO, INC., Tualatin, OR (US)

( * ) Notice: Subject to any disclaimer, the term of this patent is extended or adjusted under 35 U.S.C. 154(b) by 699 days.

(21) Appl. No.: 14/852,290

(22) Filed: Sep. 11, 2015

(65) Prior Publication Data

US 2016/0075539 A1 Mar. 17, 2016

Related U.S. Application Data

(60) Provisional application No. 62/049,274, filed on Sep. 11, 2014.

(51) Int. Cl.

| | |
|---|---|
| ***A62B 5/00*** | (2006.01) |
| *B66D 1/74* | (2006.01) |
| *A61G 1/01* | (2006.01) |
| *A61G 1/044* | (2006.01) |
| *A61G 1/048* | (2006.01) |
| *A62B 1/02* | (2006.01) |

(52) U.S. Cl.

CPC ..... *A62B 5/00* (2013.01); *A61G 1/01* (2013.01); *A61G 1/044* (2013.01); *A61G 1/048* (2013.01); *A62B 1/02* (2013.01); *B66D 1/7447* (2013.01)

(58) Field of Classification Search

CPC .... A62B 5/00; A62B 1/02; B66D 1/74–7457; B66D 1/7489

See application file for complete search history.

(56) References Cited

U.S. PATENT DOCUMENTS

| | | | |
|---|---|---|---|
| 1,270,107 | A | 6/1918 | Boardman |
| 2,361,789 | A | 10/1944 | Nicholas |
| 2,366,082 | A | 12/1944 | Albert |
| 2,899,692 | A | 7/1955 | Finken |
| 2,788,530 | A | 4/1957 | Ferguson |
| 3,046,982 | A | 7/1962 | Davis |
| 3,158,875 | A | 12/1964 | Fletcher |

(Continued)

FOREIGN PATENT DOCUMENTS

WO WO-0074785 A1 * 12/2000 ..... A61G 7/0504

OTHER PUBLICATIONS

Veasey et al., Confined Space Entry and Emergency Response, 2002, pp. 429-433, The McGraw-Hill Companies, Inc., U.S.
ARC Products, Med-Sled Vertical Lift Rescue, 2009, 2 pgs.

*Primary Examiner* — Sang K Kim
*Assistant Examiner* — Nathaniel L Adams
(74) *Attorney, Agent, or Firm* — Stoel Rives LLP

(57) ABSTRACT

An evacuation hauling system for transporting evacuation litters during an emergency. The hauling system includes a drive line forming a pathway between a first station and a second station, and a drive system operable by a drive prime mover to move the drive line between the first and second stations. An evacuation litter is detachably coupled to the drive line and is moveable along the pathway between the first and second stations as the drive line is moved. The hauling system may include a pulley supporting the drive line to maintain a separation between a transport leg of the pathway from the first station to the second station, and a return leg of the pathway from the second station to the first station.

20 Claims, 4 Drawing Sheets

(56) References Cited

U.S. PATENT DOCUMENTS

| | | | | |
|---|---|---|---|---|
| 3,247,933 | A * | 4/1966 | Hanna | B61B 12/122 104/112 |
| 3,287,895 | A | 11/1966 | Hire | |
| 3,707,734 | A | 1/1973 | Matthews | |
| 4,127,120 | A | 11/1978 | Applegate | |
| 4,151,842 | A | 5/1979 | Miller | |
| 4,283,068 | A | 8/1981 | Keyser | |
| 4,347,635 | A | 9/1982 | Eisenhauer | |
| 4,369,962 | A | 1/1983 | Hein et al. | |
| 4,601,075 | A | 7/1986 | Smith | |
| 5,014,374 | A | 5/1991 | Williams | |
| 5,027,833 | A | 7/1991 | Calkin | |
| 5,048,134 | A | 9/1991 | Dennill et al. | |
| D329,216 | S | 9/1992 | Beeley et al. | |
| D332,930 | S | 2/1993 | Clark et al. | |
| 5,205,219 | A * | 4/1993 | Groskreutz | B61B 11/002 104/173.2 |
| 5,274,864 | A | 1/1994 | Morgan | |
| 5,539,945 | A * | 7/1996 | Rosenberg | A61G 1/013 182/237 |
| 5,560,059 | A | 10/1996 | McQueen | |
| 5,568,662 | A | 10/1996 | Gougelet | |
| D379,784 | S | 6/1997 | Muhanna et al. | |
| 5,729,850 | A | 3/1998 | Eskeli | |
| 5,762,297 | A | 6/1998 | Ascherin et al. | |
| 5,819,746 | A | 10/1998 | Walton | |
| D413,553 | S | 9/1999 | Ferko, III | |
| D421,413 | S | 3/2000 | Calkin | |
| 6,059,266 | A | 5/2000 | Ascherin et al. | |
| 6,283,455 | B1 | 9/2001 | Ascherin et al. | |
| D488,107 | S | 4/2004 | Saunier | |
| D506,710 | S | 6/2005 | Hurtado | |
| 7,100,226 | B1 | 9/2006 | Walton | |
| D589,849 | S | 4/2009 | Powell et al. | |
| D608,253 | S | 1/2010 | Giduck | |
| 7,699,324 | B2 | 4/2010 | Walkingshaw et al. | |
| 7,810,820 | B2 | 10/2010 | Wolf et al. | |
| D633,829 | S | 3/2011 | Chang | |
| 8,172,238 | B2 | 5/2012 | Wolf et al. | |
| 2004/0088794 | A1 | 5/2004 | Calkin | |
| 2007/0136950 | A1 | 6/2007 | Zuercher | |

* cited by examiner

PATIENT EVACUATION AND RECOVERY HAULING SYSTEM

RELATED APPLICATIONS DATA

This application is a nonprovisional of and claims the benefit under 35 U.S.C. § 119(e) of U.S. Provisional Patent Application No. 62/049,274, filed Sep. 11, 2014, the disclosure of which is incorporated by reference herein in its entirety.

TECHNICAL FIELD

The field of the present disclosure relates generally to evacuation equipment, and in particular, to a line-hauled transport system for emergency evacuation use.

BACKGROUND

Multi-level facilities typically include stairs, escalators, ramps, and/or other similar walkways to allow people to travel between different levels of the facility. In some cases, these walkways can be extremely long, some of which may have lengths exceeding 100 feet. During emergency conditions, escalators typically do not receive power to continue their normal operation, which means that the convenience of using escalators for easy travel is lost. Accordingly, emergency personnel cannot rely on escalators to transport injured persons. While escalators may still be usable as stairs under these conditions, it can become difficult for emergency personnel to evacuate injured persons via long stretches of stairs or other similar walkways. In addition, having emergency personnel carry injured persons up stairs typically requires additional personnel that could be used elsewhere to help other injured persons.

The present inventors have determined that it would be desirable to provide a system for easily transporting injured persons up escalators, stairs, or similar walkways, while also limiting the personnel required to operate the system. Additional aspects and advantages of such a transport system will be apparent from the following detailed description of example embodiments, which proceed with reference to the accompanying drawings.

Understanding that the drawings depict only certain embodiments and are not, therefore, to be considered limiting in nature, these embodiments will be described and explained with additional specificity and detail with reference to the drawings.

DETAILED DESCRIPTION OF DISCLOSED EMBODIMENTS

Figure 1:
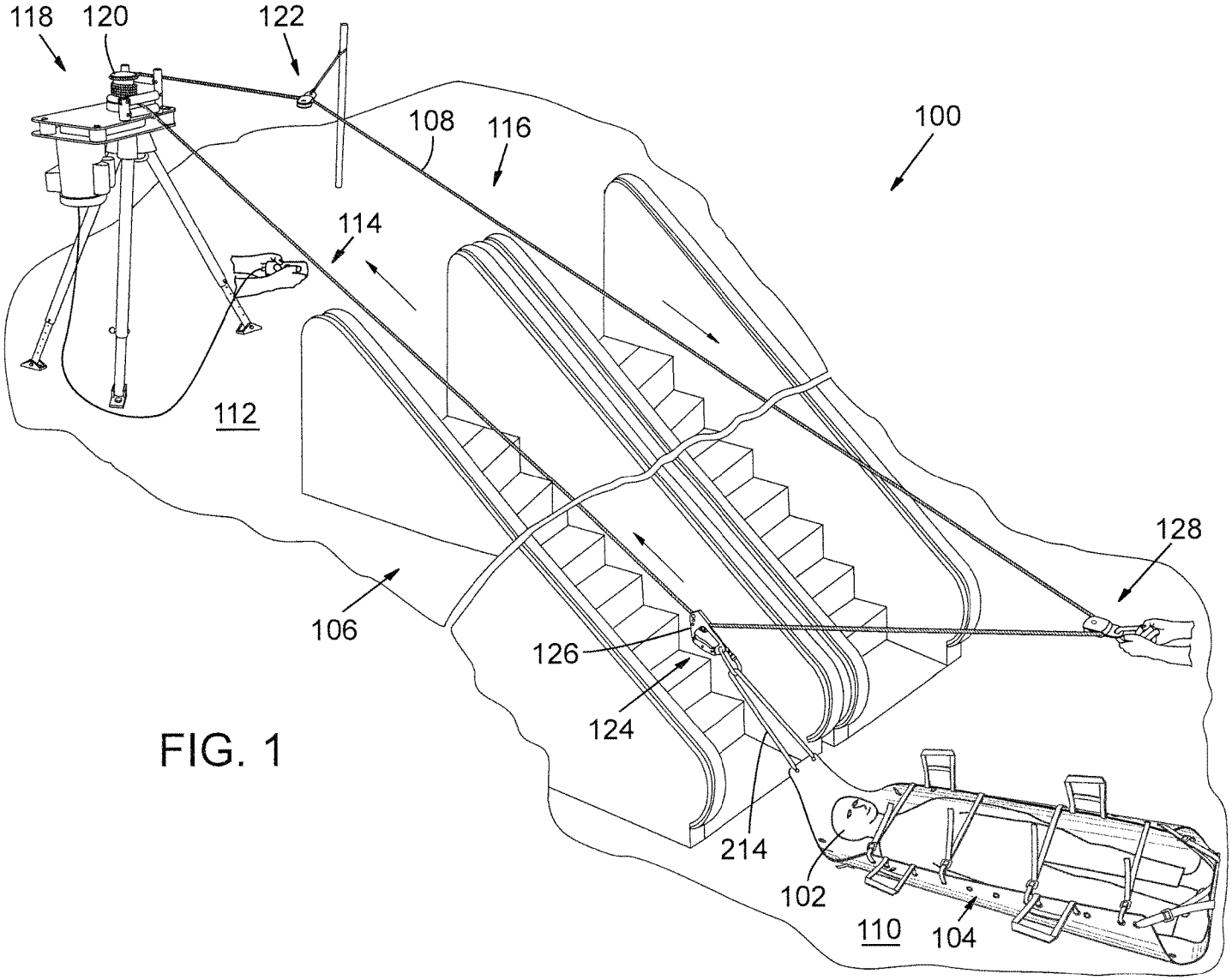
FIG. 1 is a schematic view of an embodiment of an evacuation hauling system which may be used to lift a load up an inclined plane.

With reference to the drawings, this section describes particular embodiments and their detailed construction and operation. The embodiments described herein are set forth by way of illustration only and not limitation. The described features, structures, characteristics, and methods of operation may be combined in any suitable manner in one or more embodiments. In view of the disclosure herein, those skilled in the art will recognize that the various embodiments can be practiced without one or more of the specific details or with other methods, components, materials, or the like. In other instances, well-known structures, materials, or methods of operation are not shown or not described in detail to avoid obscuring more pertinent aspects of the embodiments.

FIGS. 1-4 collectively illustrate embodiments of an evacuation hauling system 100 for easily and quickly navigating injured persons 102 up a stairway 106. It should be understood that while the embodiments illustrated in FIGS. 1-4 depict the stairway 106 as an escalator, it will be appreciated that the stairway 106 may include non-moving stairs, ramps, and/or other inclined or non-inclined walkways. The evacuation hauling system 100 includes a patient litter 104 that may be attached to and detached from a drive line 108 via a drive line attachment 126. The drive line 108 is operated via a power delivery station 118 to haul the patient litter 104 from a loading site 110 (e.g., a bottom portion of the stairs 106) and across the stairway 106 to an unloading site 112 (e.g., a top portion of the stairs 106). Once the injured person 102 reaches the unloading site 112, the patient litter 104 is detached from the drive line 108 and the injured person 102 is evacuated. Thereafter, the drive line attachment 126 is returned to the loading site 110 for loading additional injured persons.

In some embodiments, several patient litters 104 (some loaded and others empty) may be attached to drive line 108 and circulated between the loading and unloading sites 110, 112 to accommodate additional injured persons 102 and expedite the evacuation process. For example, with reference to FIGS. 1 and 4, the patient haul leg 114 may pull loaded patient litters 104, 304B along one stairway 106 (shown as an upward leg), and the litter backhaul leg 116 may return empty patient litters 304C along the other stairway 106 (shown as a downward leg) for reloading. The following sections describe additional details of these and other embodiments of the evacuation hauling system 100.

FIG. 1 illustrates an embodiment of the evacuation hauling system 100 for evacuating one or more injured persons 102 on a detachable patient litter 104. The patient litter 104 may be a stretcher or any other suitable carriage for transporting injured persons, the litter 104 preferably including straps and other features for securing an injured person thereto. With reference to the embodiment shown in FIG. 1, the evacuation hauling system 100 includes a loop of a drive line 108 that travels between a patient litter loading site 110 and a patient litter unloading site 112. The drive line 108 may include or may loop through a littler link 124 having a drive line attachment 126 for detachable connecting the litter 104 to the drive line 108 as further described with reference to FIG. 2.

Figure 4:
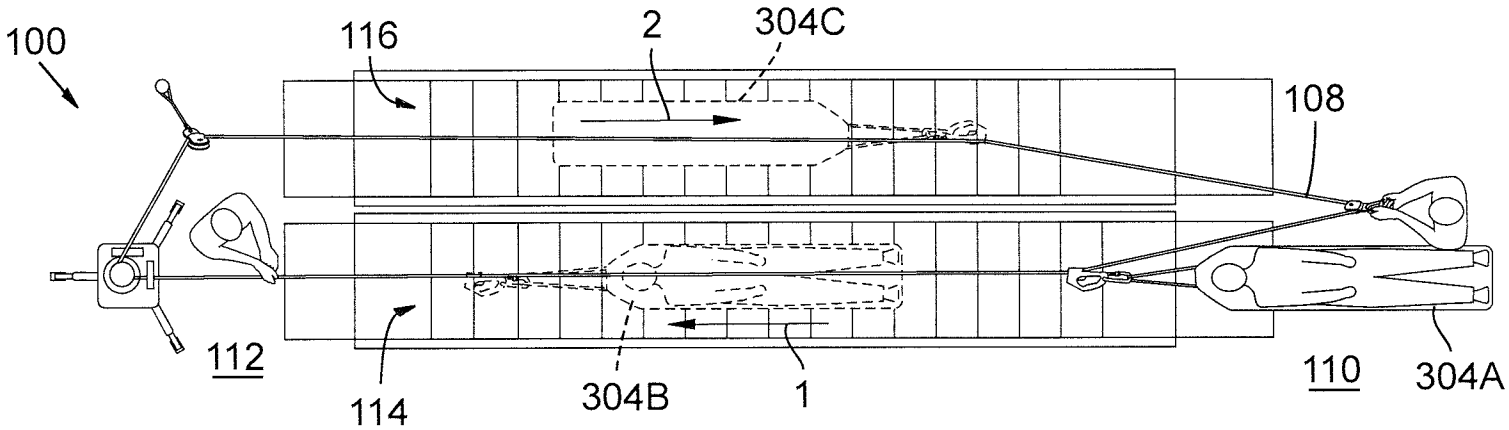
FIG. 4 is a schematic view of an example evacuation hauling system used to illustrate an embodiment of a method of using the same, shown during a loading phase.

The drive line 108 may include one or more of an endless loop of rope, cord, cable, belt, chain, or other suitable power transmission loop element that acts as a ropeway or a cableway. Preferably, the drive line 108 is arranged in a travel path having a patient haul leg 114 for pulling loaded patient litters 104 up the stairway 106 and a litter backhaul leg 116 for returning empty patient litters (not shown) down the stair way 106. In certain embodiments, such as where there are two or more stairways 106 adjacent one another (e.g., one stairway for upward traffic and another for downward traffic), the legs 114, 116 may be separated among the different stairways to provide one pathway for pulling loaded patient litters 106 up the stairway 106 and a separate pathway for returning empty patient litters 106. FIG. 4, discussed below, provides additional details and examples of this embodiment.

In other embodiments, the travel path of the drive line 108 may be different, and may depend on the layout of the stairway 106 and/or the layout of the surrounding area. For example, the stairway 106 may include one or more corners, or may be a spiral staircase, or may have any other snaking path joining the loading site 110 with unloading site 112. In such embodiments, the travel path of the drive line 108 may be arranged differently than the embodiment illustrated in FIG. 1 to provide an appropriate travel path between the loading site 110 and the unloading site 112 for the stairway arrangement. The following embodiments are described with reference to the simple out-and-back travel path as shown in FIG. 1, but it should be understood that certain aspects of the described embodiments may be easily modified to accommodate different stairway configurations without departing from the principles of the disclosed evacuation hauling system 100.

A power delivery station 118 powers the drive line 108 along the travel path to transport the patient litter 104 and injured person 102 to the unloading site 112. With reference to FIG. 1, the power delivery station 118 includes a drive 120 for moving the drive line 108 along the travel path. The drive line 108 may be supported by a first direction change pulley 122 laterally offset and proximate the power delivery station 118 at the unloading site 112, and a second direction change pulley 128 positioned adjacent the loading site 110. Preferably, the first and second pulleys 122, 128 are laterally offset from the patient haul leg 114 such that the drive line 108 forms a generally quadrilateral shape between the patient haul leg 114 and the litter backhaul leg 116. In some embodiments, first pulley 122 and/or second pulley 128 may include a knot-passing pulley that permits a knot to pass therethrough. Additional details and features of the power delivery station 118 are described below with reference to FIG. 3.

Figure 2:
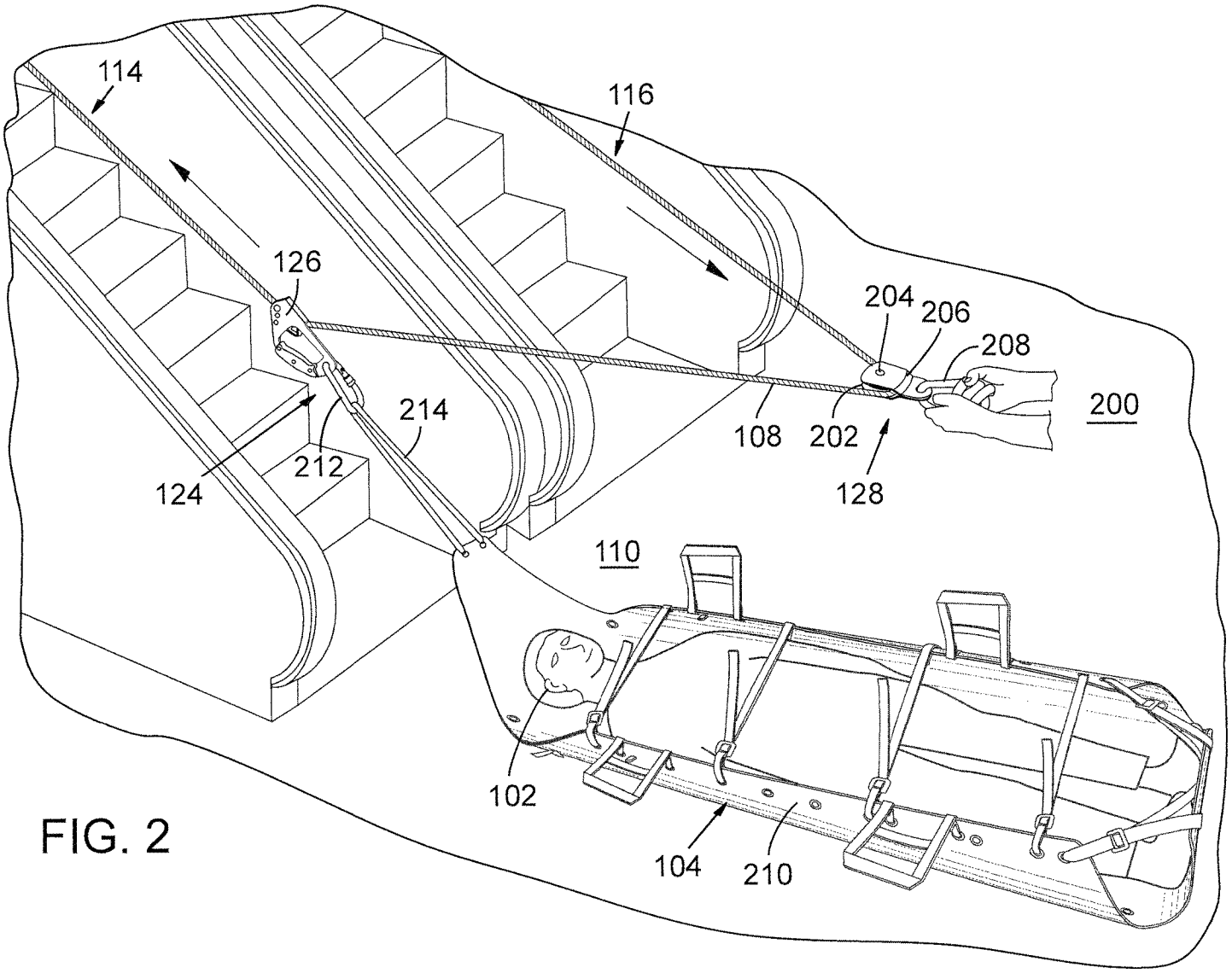
FIG. 2 is a schematic view of an embodiment of the evacuation hauling system illustrating additional details relating to loading a patient litter.

FIG. 2 depicts an embodiment of a drive line return station 200 of the evacuation hauling system 100. With reference to FIG. 2, the drive line return station 200 includes the second direction change pulley 128. The pulley 128 includes a sheave 202 supported on an axle 204 that rests within shell 206. In some embodiments, a shell link 208 may be coupled to the shell 206 to provide a support attachment location and/or provide horizontal/vertical adjustment of the second direction change pulley 128 within the loading site 110. As mentioned previously, the drive line 108 loops around the second direction change pulley 128 and reverses direction so that the drive line 108 is divided into the legs 114, 116. While the embodiment of drive line return station 200 is shown in FIG. 2 as being supported by a user (e.g., by directly holding the direction change pulley), in some embodiments it may be supported in part or entirely by a temporary or permanent structure, such as a stanchion, bracket, beam, or column similar to the first direction change pulley 122.

With reference to FIG. 2, the patient litter 104 may include an elongated base panel 210 formed of a lightweight and flexible material with strength and durability characteristics suitable for supporting the weight of an injured person during transport, although some embodiments may be configured to carry rescue equipment (e.g., fire extinguishers, air packs, lights, power supplies, and tools, among other equipment). In some embodiments, the base panel 210 may comprise a single sheet of lightweight polymeric material, such as a suitable polyolefin (e.g., medium-density polyethylene) or a thermoplastic resin. Regardless of the material of choice, the base panel material may be selected based on one or more of the durability, strength, flexibility, and resistance to damage (such as from cutting, scarring, denting, breaking, and deforming) of the selected material. Some non-limiting examples of suitable patient litters include embodiments disclosed in U.S. Pat. Nos. 6,871,368 and 8,677,530.

The detachable patient litter 104 is shown attached to a portion of the drive line 108 traversing up the stairway 106 along the patient haul leg 114. In some embodiments, the patient litter 104 (e.g., base panel 210) may be connected to the drive line 108 via a clip 212 (such as a D-clip) connected to litter webbing 214 or other handle structure (not shown). The clip 212 (and the litter webbing 214) may be coupled with the drive line 108 via a detachable litter link 124, which includes a drive line attachment 126 (e.g., a rope grab or a cable grab). The clip 212 may also allow the drive line attachment 126 to remain connected to the drive line 108, while the clip 212 is used to detachably couple litter 104 to the drive line attachment 126 and the drive line 108.

In some embodiments, the drive line attachment 126 may include a modified ascender employing a cam or other mechanism allowing the modified ascender to slide freely along drive line 108 in one direction while firmly gripping drive line 108 when urged in the opposite direction (e.g., urged under the influence of gravity), while permitting the cam or other mechanism to open easily with one hand (that is, singlehandedly). This feature may provide a way to rapidly, yet securely, fasten and detach the patient litter 104.

In some embodiments, the drive line attachment 126 may be configured so that a user may manually haul the patient litter 104 by exerting a pulling force along a stopped or slowed drive line 108 in one direction while preventing backsliding during rest stops and intermittent pauses, among other interruptions to the pulling force. In some other embodiments, drive line attachment 126 may include one or more clamps, clips, rings, or fasteners that, with or without the use of a tool, temporarily secure litter link 124 and/or litter webbing 214 with drive line 108.

Figure 3:
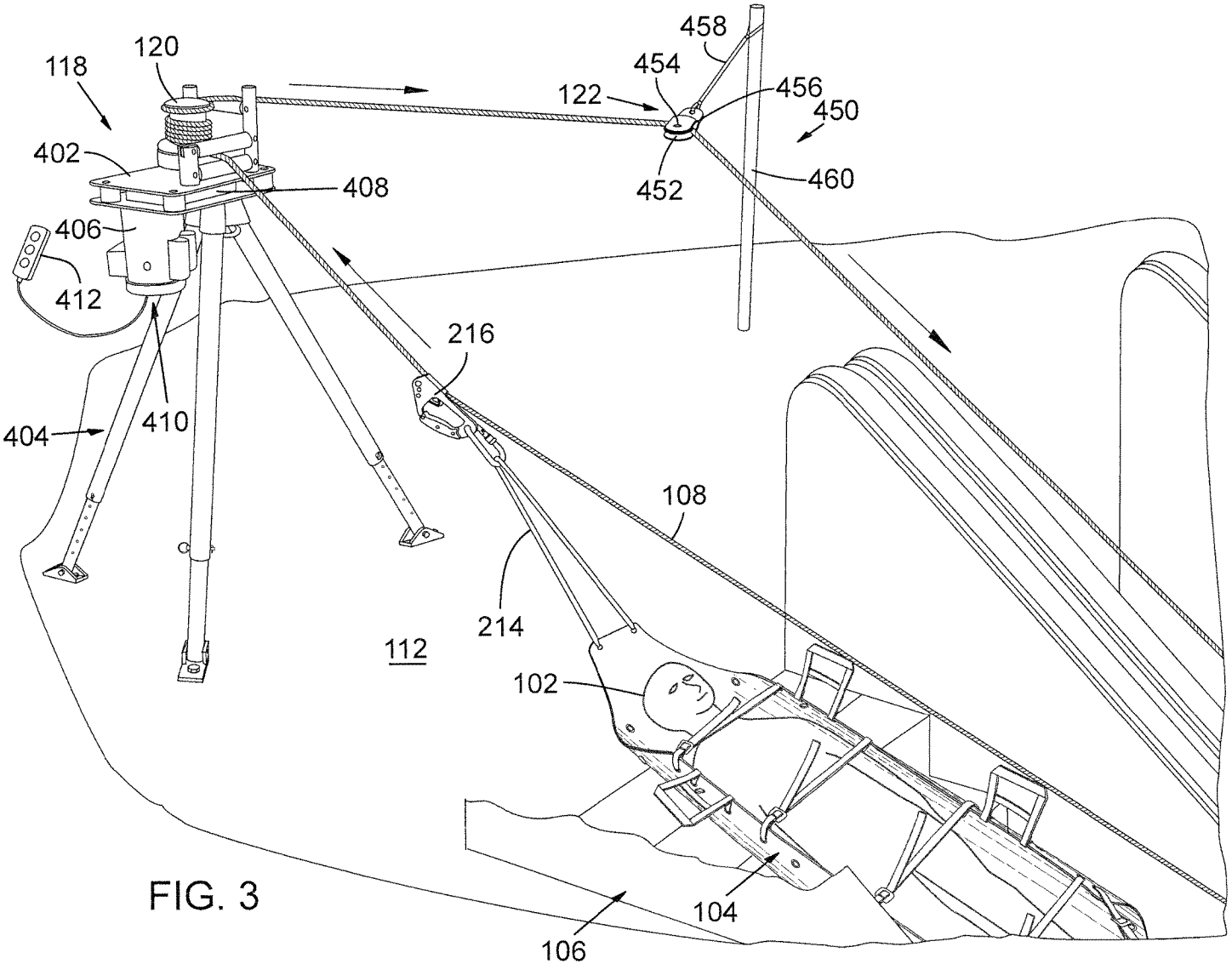
FIG. 3 is a schematic view of an embodiment of the evacuation hauling system illustrating additional details relating to transporting the patient litter.

As mentioned previously, the evacuation hauling system 100 includes a power delivery station 118 for moving the drive line 108 along the travel path to transport the patient litter 104 and injured person 102 up the stairway 106 to the unloading site 112. FIG. 3 illustrates additional details of the power delivery station 118. With reference to FIG. 3, the drive line 108 is pulled along its travel path by a rotating force transferred to the drive line 108 via a drive 120 using one or more of a barrel, bullwheel, capstan, cylinder, drum, gear, spool, sprocket, wheel, winch, or windlass, or a combination thereof, or some other suitable drive line transmission element included in power delivery station 118. In some embodiments, two or more drives 120 may be distributed within a power delivery station 118 using a suitable coordinated drive system that coordinates power distribution among the individual drives. In some embodiments, two or more power delivery stations 118 may be provided to introduce power to drive line 108. For example, power delivery stations 118 may be provided at both loading site 110 and unloading site 112, or at either station, or alternatively/additionally at an intermediate site if included, potentially smoothing power distribution therein.

With reference to FIG. 3, drive 120 is shown positioned above an upper threshold of stairway 106 on an elevated platform 402, so that drive line 108 does not drag across a corner of the threshold. This position may reduce wear of the drive line 108 and/or may provide a gentle transition as patient litter 104 transitions between an inclined attitude assumed while ascending stairway 106 and a horizontal attitude assumed upon reaching the threshold.

In the embodiment shown in FIG. 3, elevated platform 402 is supported by adjustable (e.g., telescoping and/or folding) legs 404 (or another suitable support structure) that permit height and/or attitude adjustment of elevated platform 402 relative to the threshold. In some embodiments, the legs 404 may be secured to a surface at the unloading site 112 using one or more fasteners (e.g., bolts, screws, nails, adhesives, and the like). For example, the embodiment shown in FIG. 3 illustrates the feet attached to legs 404 bolted or shot-nailed into a floor surface at unloading site 112. In some embodiments, the elevated platform 402 may be suspended from a support structure located above the surface (e.g., using hooks and straps). In other embodiments, elevated platform 402 may be held aloft by a side-mounted support structure, such as by being cantilevered from a bracket, for example.

The elevated platform 402 supports the drive 120. In some embodiments, the drive 120 may be mounted directly to a top surface of the elevated platform 402. In other embodiments, the drive 120 may instead be mounted on a vertical axle, a horizontal axle, or an axle positioned in a different orientation relative to the top surface of the elevated platform 402.

The drive 120 is powered by a drive prime mover 406, which may deliver power directly to the drive 120 or via a powertrain 408. The powertrain 408 may include a gearbox, a worm drive, a power transmission system, and/or a chain/belt drive to transfer power from the drive prime mover 406 to the drive 120 and, in some of such embodiments, to alter an angular velocity of the drive 120 relative to that of a rotary drive shaft of the drive prime mover 406. As mentioned previously, the drive line 108 is moved via the drive 120, with the drive line 108 being looped one or more times around the drive 120, or traveling around a portion of the drive 120.

In the embodiment shown in FIG. 3, the drive prime mover 406 includes an electric motor mounted to an underside of the elevated platform 402, though it will be appreciated that the drive prime mover 406 may be positioned elsewhere on the elevated platform 402 or even elsewhere within power delivery station 118, so long as the drive prime mover 406 is operatively coupled with the drive 120 so that power can be transmitted thereto (e.g., via powertrain 408).

In the example shown in FIG. 3, the drive prime mover 406 is operated via a controller 410, which is depicted as including a tethered remote 412. Generally, the controller 410 is responsible for controlling and operating various aspects of the drive prime mover 406, including controlling a drive line speed and/or direction and electrical power control and delivery. Additionally or alternatively, in some embodiments a manually operated drive prime mover (e.g., a hand crank or a power tool attachment) may be coupled with drive 120 so that a user may manually supply a driving force to the drive 120. A manually operated drive prime mover may be beneficial when powered operation of drive prime mover 406 and/or controller 410 is not available or inoperative, such as due to an electrical or power outage.

In some embodiments, the drive line 108 may also be looped around a tension station 450 (shown at unloading site 112 in FIG. 3) which may be located at loading site 110, unloading site 112, and/or an intermediate site located along one of the legs 114, 116 between the loading and unloading sites. The tension station 450 may help separate the legs 114, 116 from one another and/or to guide the legs 114, 116 around curves or corners and/or elevation changes anywhere in the path of drive line 108. Similar to return station 200, tension station 450 is shown including direction change pulley 122 that includes a sheave 452 supported on an axle 454 which rests in shell 456. A shell link 458 (e.g., a cable, rope, or chain supported by a temporary or permanent structure, such as a bracket, or by a user) may be used to couple shell 456 with a tension station support 460 holds direction change pulley 122 at a preselected height and position to guide drive line 108 to the next leg.

FIG. 4 illustrates an example use of the evacuation hauling system 100 for transporting an injured person 102 from the loading site 110 to the unloading site 112 for subsequent evacuation. With reference to FIG. 4, the injured person 102 is loaded onto the patient litter 304A at the loading site 110. Once loaded, the litter 304A is hauled via the power delivery station 118 and the drive line 108 along haul leg 114 in the direction of travel marked by arrow 1 toward unloading site 112, as shown at 304B in FIG. 3. Once the litter 304B reaches the unloading site 112, the patient litter 304B is detached from the drive line 108 for patient evacuation. Preferably, as the litter 304B is being hauled upwardly along the stairway 106, one or more empty litters 304C attached to the drive line 108 may be hauled along litter backhaul leg 116 in the direction of travel marked by arrow 2 down the stairway 106. As the loaded litter 304B reaches the unloading site 112, the empty litter 304C reaches the loading site 110, where it may be used to load another injured person 102.

In the embodiment illustrated in FIG. 4, the evacuation site includes a pair of stairways 106 adjacent one another. In such embodiments, separating the legs 114, 116 between the stairways 106 may help accommodate the use of multiple litters to maintain loaded patient litters 304B moving upwardly while also having empty patient litters 304C simultaneously moving downwardly on a separate stairway 106 so as to avoid having the litters interfere with one another. In such a configuration, the injured person 102 may be removed from the loaded patient litter 104 upon reaching the unloading site 112 at the same time as another injured person 102 is loaded on the empty litter 104 at the loading site 110, as mentioned previously.

It is intended that subject matter disclosed in any one portion herein can be combined with the subject matter of one or more other portions herein as long as such combinations are not mutually exclusive or inoperable. In addition, many variations, enhancements and modifications of the concepts described herein are possible.

It will be obvious to those having skill in the art that many changes may be made to the details of the above-described embodiments without departing from the underlying principles of the invention. The scope of the present invention should, therefore, be determined only by the following claims.

The invention claimed is:

1. An evacuation hauling system for transporting evacuation litters, the evacuation hauling system comprising:

a drive line forming a pathway between a first station and a second station, wherein the pathway includes a transport leg from the first station to the second station and a return leg from the second station back to the first station;

a drive positioned at one of the first station or the second station, the drive operatively associated with the drive line and moving the drive line along the pathway between the first and second stations;

a drive prime mover operatively coupled to the drive and configured to power the drive;

a first pulley positioned at one of the first station or the second station, the pulley supporting at least a portion of the drive line and directing the pathway of the drive line so that the transport leg and the return leg are offset from one another to avoid overlap along the pathway; and a first evacuation litter detachably coupled to the drive line and moveable along the pathway between the first and second stations, the first evacuation litter including a flexible base panel sized to underlay and support a person laying thereon, the flexible base panel having a header section and an opposite footer section, and a first peripheral side and an opposite second peripheral side, the footer section configured to roll inwardly to provide a foot support for the person, the first evacuation litter further including one or more restraining straps each extending transversely across the flexible base panel from the first peripheral side to the second peripheral side for securely restraining the person within the first evacuation litter, and an attachment strap positioned along the header section for coupling the first evacuation litter to the drive line, wherein the drive line and the attachment strap together urge the header section of the flexible base panel to roll upwardly toward the drive line in a rolled configuration to form a head support for the person, and wherein the drive line and the attachment strap together maintain the header section in the rolled configuration during movement of the first evacuation litter along the pathway between the first and second stations.

2. The evacuation hauling system of claim 1, wherein the drive line is looped around the drive.

3. The evacuation hauling system of claim 1, further comprising a controller in electrical communication with the drive prime mover, the controller operable to selectively control the drive prime mover.

4. The evacuation hauling system of claim 3, wherein the controller is a remote controller in wireless communication with the drive prime mover.

5. The evacuation hauling system of claim 1, wherein the first evacuation litter is detachably coupled to the drive line via a drive line attachment.

6. The evacuation hauling system of claim 5, wherein the drive line attachment includes an ascender which can be opened singlehandedly.

7. The evacuation hauling system of claim 5, wherein the drive line attachment includes a rope or cable grab.

8. The evacuation hauling system of claim 1, wherein the drive line includes a power transmission loop element selected from the group consisting of a rope, a cord, a cable, a belt, or a chain.

9. The evacuation hauling system of claim 1, wherein the drive includes a drive line transmission element selected from the group consisting of a barrel, a bullwheel, a capstan, a cylinder, a drum, a gear, a spool, a sprocket, a wheel, a winch, or a windlass, or a combination thereof.

10. The evacuation hauling system of claim 1, wherein the pathway between the first and second stations is an inclined plane.

11. The evacuation hauling system of claim 1, wherein the first pulley includes a knot-passing pulley.

12. The evacuation hauling system of claim 1, further comprising a second pulley positioned at the other of the first station or second station relative to the first pulley, the second pulley supporting the drive line and offsetting the transport leg and the return leg from one another so that the transport and return legs do not overlap along the pathway.

13. The evacuation hauling system of claim 1, further comprising:

a second evacuation litter detachably coupled to the drive line, wherein the second evacuation litter travels along the return leg of the pathway from the second station to the first station as the first evacuation litter travels along the transport leg of the pathway from the first station to the second station.

14. The evacuation hauling system of claim 12, the second pulley further including a shell link coupled thereto, the shell link being movable along a horizontal and vertical axis to adjust a position of the second pulley.

15. A method of transporting evacuation litters via an evacuation hauling system, the method comprising:

positioning a first pulley at one of a first station or a second station;

forming, via a drive line supported by the first pulley, a pathway between the first station and the second station, the pathway including a transport leg from the first station to the second station and a return leg from the second station back to the first station, wherein the first pulley separates the drive line so that the transport leg and the return leg are offset from one another to avoid overlap along the pathway;

detachably coupling a first evacuation litter to the drive line, the first evacuation litter being movable along the pathway between the first and second stations;

powering a drive, via a drive prime mover operatively coupling to the drive, the drive positioned at one of the first station or the second station; and moving, via the drive, the drive line and first evacuation litter along the transport leg of the pathway between the first and second stations, wherein the first evacuation litter includes a flexible base panel sized to underlay and support a person laying thereon, the flexible base panel having a header section and an opposite footer section, and a first peripheral side and an opposite second peripheral side, the footer section configured to roll inwardly to provide a foot support for the person, the first evacuation litter further including one or more restraining straps each extending transversely across the flexible base panel from the first peripheral side to the second peripheral side for securely restraining the person within the first evacuation litter, and an attachment strap positioned along the header section for coupling the first evacuation litter to the drive line, wherein the drive line and the attachment strap together urge the header section of the flexible base panel to roll upwardly toward the drive line in a rolled configuration to form a head support for the person, and wherein the drive line and the attachment strap together maintain the header section in the rolled configuration during movement of the first evacuation litter along the pathway between the first and second stations.

16. The method of claim 15, further comprising selectively controlling the drive prime mover via a controller in electrical communication with the drive prime mover.

17. The method of claim 15, wherein the pathway between the first and second stations is an inclined plane.

18. The method of claim 15, further comprising positioning a second pulley at the other of the first station or second station relative to the first pulley, and wherein forming the pathway further includes supporting the drive line on the second pulley.

19. The method of claim 15, further comprising:

detachably coupling a second evacuation litter to the drive line; and moving, via the drive, the drive line and the second evacuation litter along the return leg of the pathway from the second station to the first station as the first evacuation litter travels along the transport leg of the pathway from the first station to the second station.

20. The method of claim 15, further comprising:

coupling, a shell link to the second pulley; and adjusting a position of the second pulley by moving the shell link along one or both of a horizontal and vertical axis.

* * * * *